United States Patent [19]

Zuccaro et al.

[11] 4,091,467

[45] May 30, 1978

[54] METHOD OF MAKING CAPS ON A CONTINUOUS PRODUCTION LINE AND CAPS OBTAINED THEREBY

[75] Inventors: Robert Zuccaro, Lyons; Pierre Lory, La Duchere Lyon, both of France

[73] Assignee: Plymatic, Villeurbanne, France

[21] Appl. No.: 703,252

[22] Filed: Jul. 7, 1976

[30] Foreign Application Priority Data

Jul. 9, 1975 France ..... 75 21544

[51] Int. Cl.[2] ..... A42C 1/00; A42B 1/04

[52] U.S. Cl. ..... 2/192; 2/202

[58] Field of Search ..... 2/192, 195, 197, 200, 2/202, 175, 194, 196, 209.1

[56] References Cited

U.S. PATENT DOCUMENTS

| | | | |
|---|---|---|---|
| 3,394,409 | 7/1968 | Wagenfeld | 2/195 |
| 3,523,303 | 8/1970 | Wagenfeld | 2/192 X |
| 3,571,812 | 3/1971 | Speevak | 2/197 |

*Primary Examiner*—Werner H. Schroeder
*Assistant Examiner*—Peter Nerbun
*Attorney, Agent, or Firm*—Kenyon & Kenyon, Reilly, Carr & Chapin

[57] ABSTRACT

A method of making caps on a continuous production line comprising: causing a first web to travel continuously in a given running direction; laying and securing transversely at substantially regular spaced intervals onto said first-named web, portions of a second web moving parallel to the direction of travel of said first web, each portion of said second web forming a separate element cut from said second web or being integral therewith so as to define rectangular elements adapted to form the crowns of the caps, the fastening of each rectangular element being performed along a line extending transversely of said running direction along a first edge of said rectangular element; forming a flat tube with longitudinal folds from said first web carrying said rectangular elements during or before assembling together the other edges of each one of said rectangular elements, both edges of each said element parallel to said running direction being secured together and the second edge of said element transverse to the first web then being folded and parallel to said first edge of each said element along which is effected its said original fastening being assembled to itself; connecting together both opposite longitudinal edges of said first web sequentially at regular spacings to form a flat tube and cutting said flat tube at regular spacings for severing individual of said caps therefrom.

27 Claims, 19 Drawing Figures

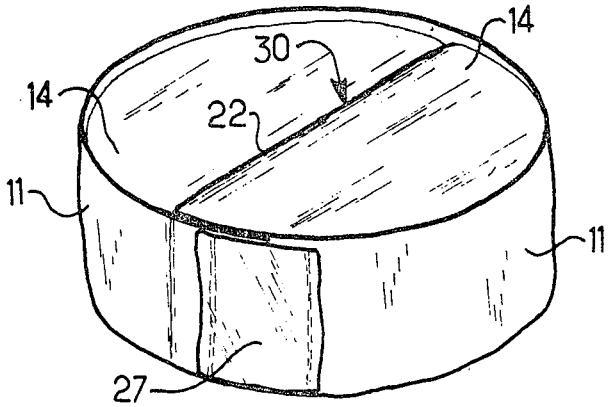
Fig: 6.
Fig: 4.
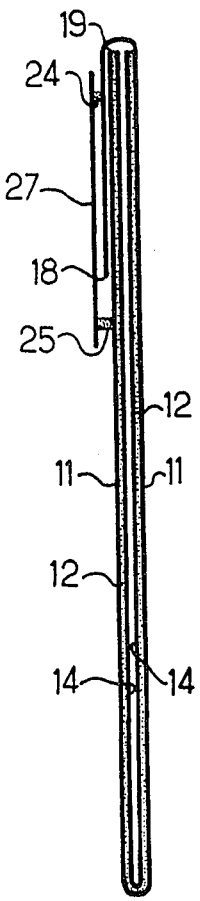
Fig: 3.
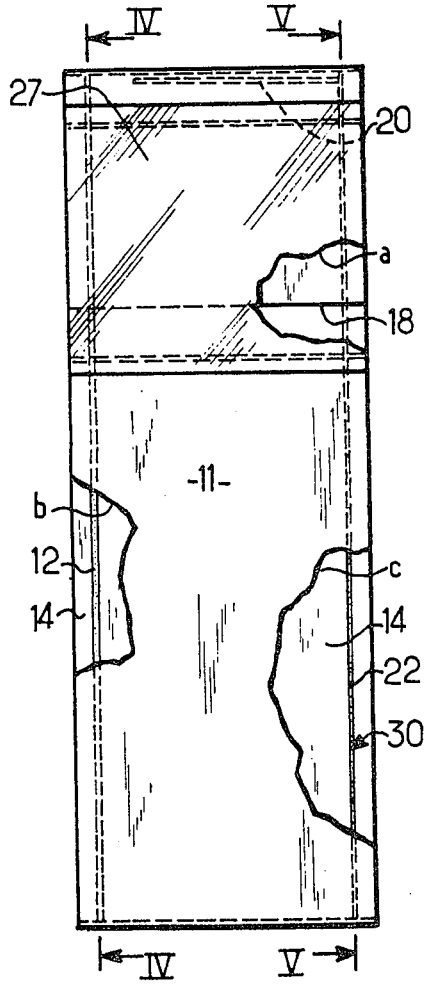
Fig: 5.
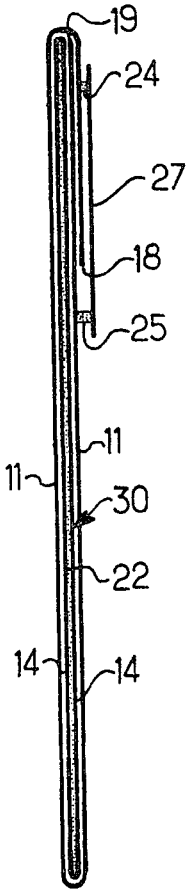

METHOD OF MAKING CAPS ON A CONTINUOUS PRODUCTION LINE AND CAPS OBTAINED THEREBY

The present invention relates essentially to a method of making, on a continuous production line basis, caps or like head-dresses or headgears, in particular disposable caps which may be thrown away after use with the purpose of making all the folding and assembling steps automatic and thereby minimizing the manufacturing cost price.

It is known that some industrial sectors or hospitals make use to an increasing extent of caps disposable after use every time a technician or a surgeon has to perform requiring particularly hard operating conditions as to cleanliness and/or safety. In particular, in a hospital the surgeons deem it more and more preferable to use such sterile caps for their a principal, the manufacturing cost price of which has become comparable to the expenses for cleaning and sterilizing recoverable fabric caps which have been used heretofore.

It is moreover possible to contemplate a new development of the use of such products or articles if one succeeds in decreasing the manufacturing costs still more. This is possible only owing to the use of new manufacturing processes and in particular of methods for making on a continuous production line basis caps and like head-dresses or headgears enabling to achieve at the same time a high production rate or fast manufacturing process, a better reliability or dependability and a reduced manufacturing cost price. This is a principal object of the method according to the invention.

More specifically the invention accordingly relates to a method for making caps and like head-dresses or headgears on a continuous production line basis, characterized in that it consists in:

causing a first web to continuously travel in a given running direction of travel;

laying and securing transversely in substantially regularly spaced relationship onto said first web portions of a second web moving above the direction of travel of said first web, each portion of said second web constituting a separate element cut off from said second web or being integral therewith so as to define rectangular elements adapted to form the crowns of the caps, the fastening of each rectangular element being effected along a line extending in at least approximatively transverse relation to said running direction of travel for instance along a first edge of said rectangular element;

forming a flat tube possibly with longitudinal folds, creases or tucks from said first web carrying said rectangular elements during or before proceeding with assembling to each other or connecting together the other edges of each one of said rectangular elements, both edges of each said element parallel to said running direction of travel being assembled together and the second edge of each said element then in folded state and parallel to the first edge thereof along which is effected said fastening being connected to itself;

assembling with each other or connecting together both opposite longitudinal edges of said first web optionally sequentially in regularly spaced relationship to form a flat tube; and cutting said flat tube in substantially regularly spaced relationship for severing individual of said caps therefrom.

As it will become apparent hereinafter this method enables obtention of directly folded caps which when reaching the end of the production line are ready to be used while avoiding any expensive handling or manipulation and whose conditioning or packing is very easy to be carried out. In particular, the extremely regular geometrical shapes of the folded caps obtained at the end of the production line readily enables effecting their packing or conditioning into distributor boxes, cans or like containers.

Furthermore, the process according to the invention contemplate many alternative embodiments enabling the provision of caps of a very differing shapes possibly comprising extensible or stretchable elements with a view to a better adaptation or improved fit to the head of the wearer or user.

For instance, it has been noticed that by modifying some adjustments or some parameters of the method it was possible to obtain products or articles with different dimensional and aesthetic features. These parameters are in particular the width of the first continuous web and those of the rectangular elements which are secured thereto, the spacing between any two successive elements, the positions of some gluing strokes or lines or dots and so on.

Bearing this in mind the invention also relates to some alternative embodiments of the method enabling provision of cow-like or hood-shaped headgears, i.e. headgears the diameters of which are large enough to permit the whole head to be inserted therein (this modification is trivial and relates only to the width of said first web and to the lengths of the corresponding rectangular elements) and the heights of which are large enough to fully cover the head of the wearer or user.

More particularly, the invention also relates to a method according to the definition thereof given hereinabove and characterized by the steps of laying and securing said separate previously cut elements onto said first web while leaving some spacings between the successive separate elements, said spacings later defining in the finished state of each corresponding head-dress or headgear a lower or bottom cowl-like or hood-shaped extension thereof and forming at least one cut-out part or opening in each area of said first web corresponding to said spacing.

It is moreover preferable that the headgear or cowl or hood fits the shape of the head in the best possible way. Keeping this in mind the invention provides a modification of the manner of securing or fastening the separate rectangular elements onto said first web as well as of the manner of performing the cutting of the flat tube provided subsequently.

More specifically according to the invention the aforesaid fastening of each rectangular element to said first web carried out at right angles to said running direction of travel is effected along a curved assembly line exhibiting a cusp or like point of reflection or retrogression located substantially in the middle of said first web, said assembly line being symmetrical with respect to that cusp or point of retrogression while being substantially straight on either side of the latter and bent at each one of its ends in the same direction as said cusp and the subsequent cutting off or severing of said finished caps or head-dresses after formation of said flat tube is effected along the contour of said assembly line superimposed to itself, said cut-out being carried out after said flat tube has been formed, along one edge of the latter.

At last another object of the invention is the provision of fastening or tie strings at the bottoms of the cowls or hoods, i.e. about the neck.

The invention will be better understood and further objects, details, characterizing features and advantages thereof will appear more clearly as the following explanatory description proceeds with reference to the accompanying diagrammatic drawings given by way of non limiting examples only illustrating several presently preferred specific embodiments of the invention and wherein:

FIGS. 1 and 2 diagrammatically show a sequence of operating steps or processes of a method for making head-dresses or caps to the invention said operating steps being identified or designated in a possible logical sequence by letters A to D taken in alphabetical order from the left to the right, respectively, in FIG. 1 and then letters D to G in the same direction in FIG. 2;

FIG. 3 is a view with parts broken away of a unit cap or headgear obtained by utilizing the method illustrated in FIGS. 1 and 2;

FIG. 4 is a view in section taken upon the line IV—IV in FIG. 3;

FIG. 5 is a view in section taken upon the line V—V in FIG. 3;

FIG. 6 is a view of the same headgear or cap in its unfolded condition shown on a smaller scale;

Figure 8:
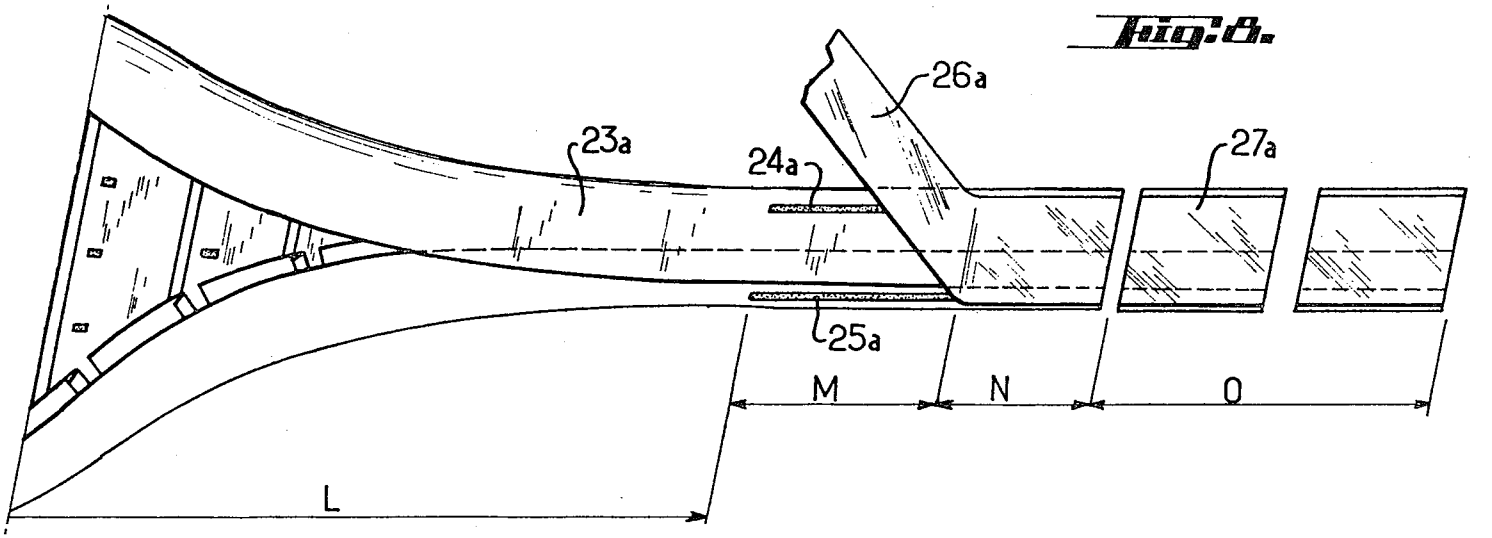
Figure 13:
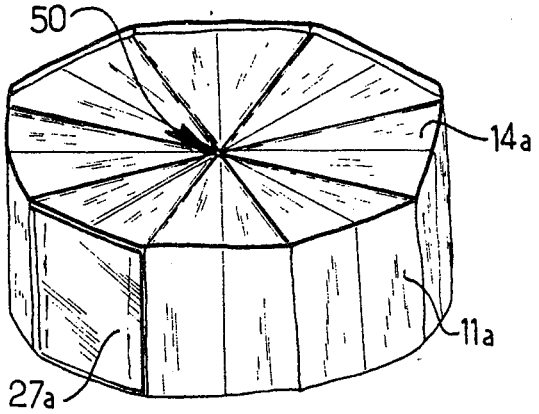
Figure 14:
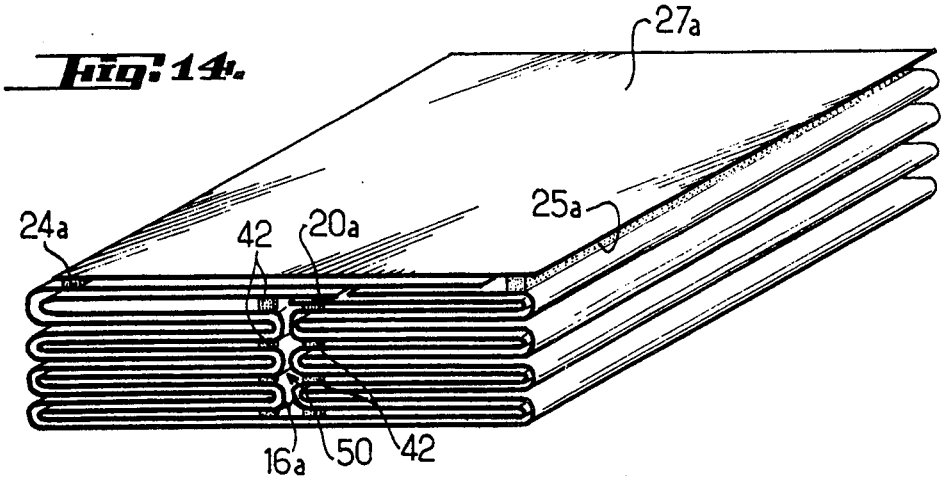
Figure 15:
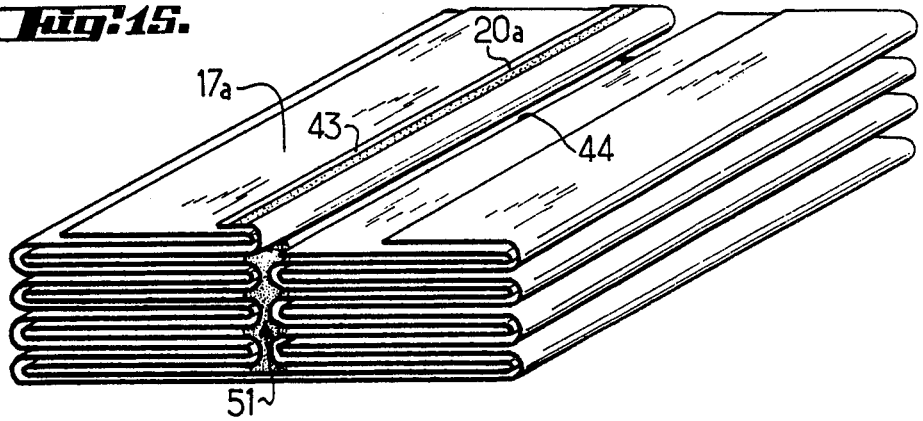
Figure 16:
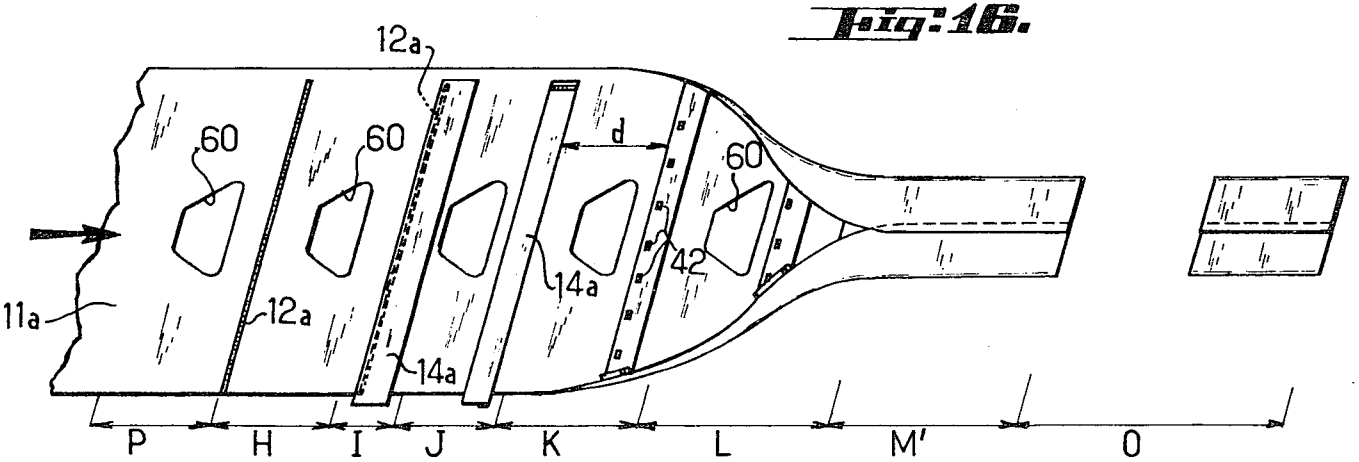
Figure 19:
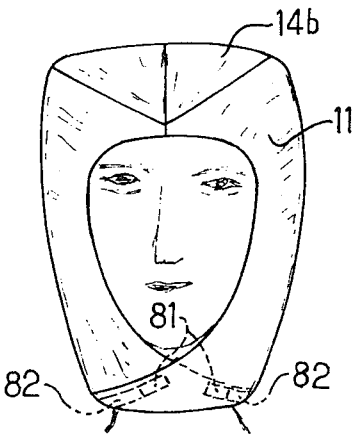
Figure 18:
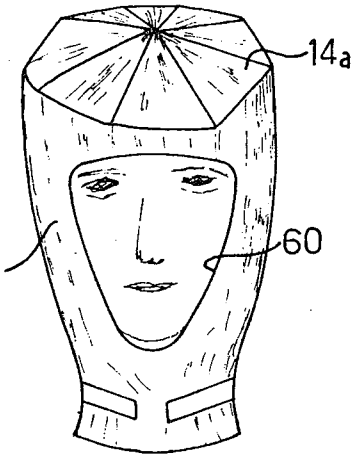
Figure 17:
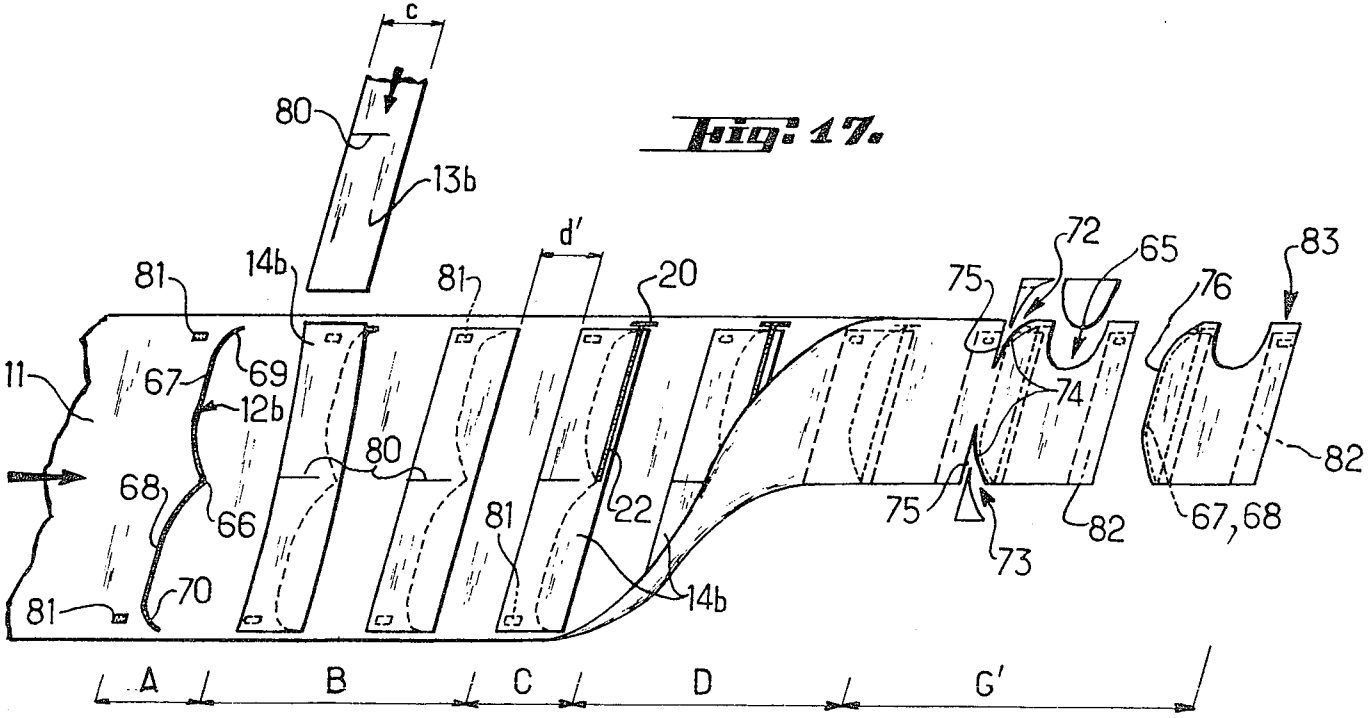

FIGS. 7 and 8 diagrammatically illustrate another sequence of operating steps of a second process for making caps or like head-dresses according to the principles of the invention, said operating steps being identified or denoted in a possible logical sequence by letters H to L taken in alphabetical order from the left to the right in FIG. 7 and then letters L to O in the same direction in FIG. 8;

FIGS. 9 to 12 show possible further examples of gluing streaks, threads or like fastening lines or marks which may be applied at a given process step of the method diagrammatically depicted in FIGS. 7 and 8;

FIG. 13 shows a cap in its unfolded condition provided by the use of the method of manufacture diagrammatically depicted in FIGS. 7 and 8;

FIG. 14 shows a view drawn on a different scale of the same cap in its folded-up condition such as it is obtained at the exit from the production line;

FIG. 15 depicts an intermediate stage in the manufacture of the same cap according to an alternative embodiment of the method illustrated diagrammatically in FIGS. 7 and 8;

FIG. 16 diagrammatically depicts some modifications of the method of making caps or like headgears described with reference to FIGS. 7 and 8, including new or modified operating steps enabling provision of cowls or hoods;

FIG. 17 diagrammatically shows some modifications of a method of making caps and like head-dresses described with reference to FIGS. 1 and 2, comprising new or modified operating steps enabling the obtention of cowls or hoods;

FIG. 18 shows a cowl or hood in its unfolded condition obtained by using the method illustrated in FIG. 16; and FIG. 19 shows a cowl or hood in its unfolded condition obtained by using the method depicted in FIG. 17.

DETAILED DESCRIPTION

Figure 1:
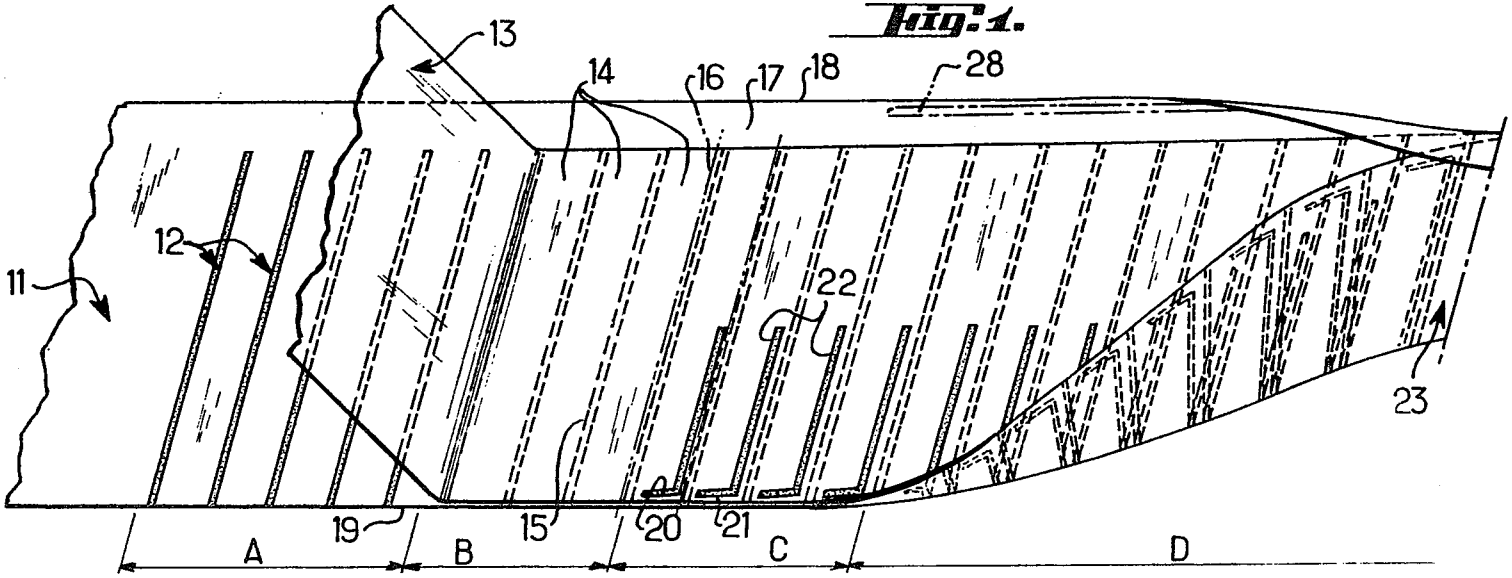
Figure 2:
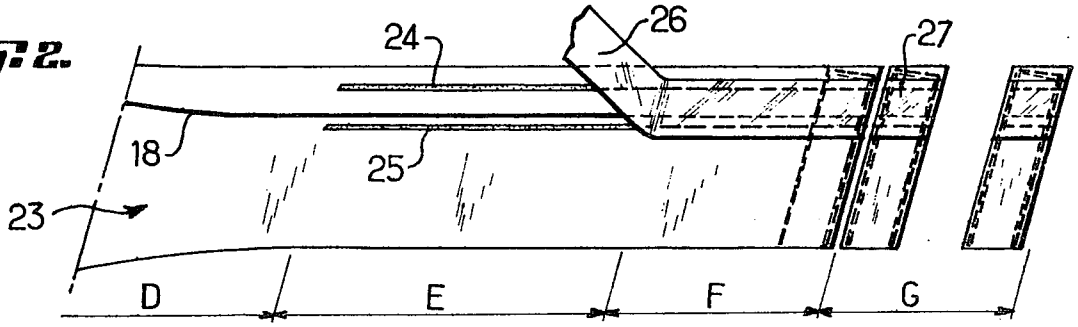
Figure 2:
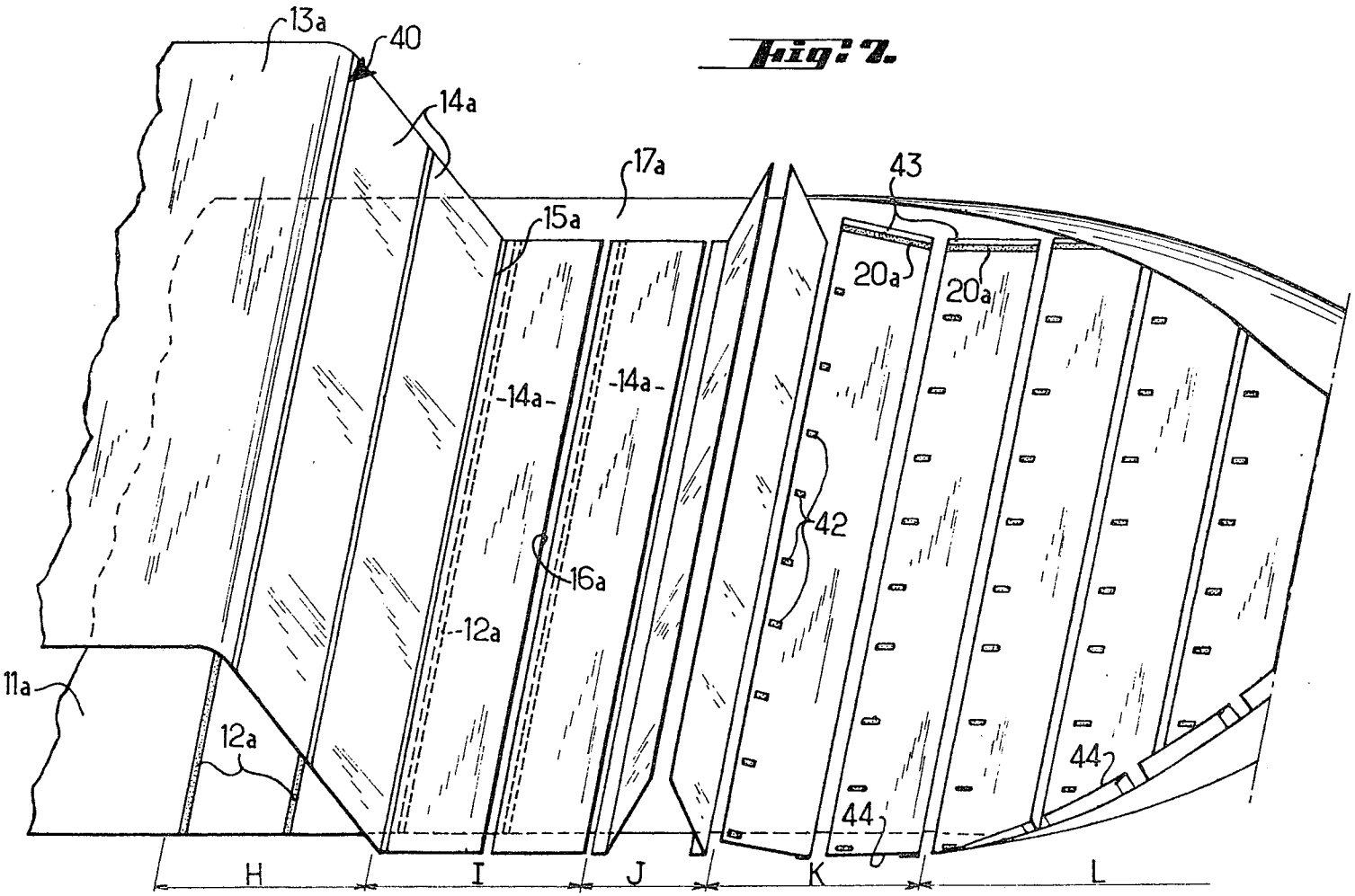

With reference to FIGS. 1 and 2 it is seen that the use or performance of the method requires a continuous web or sheet 11 moving forward at a selected speed from left to right in FIGS. 1 and 2 on a machine not shown. This web may be made from any flexible and pliable, woven or non woven material such as paper or possibly any synthetic fabric. The method is started by laying down or applying at regular spacings transverse gluing marks, threads, strokes or like lines 12 (step A). These gluing marks are preferably applied as strokes or streaks of a thermofusible glue or like heat sealable adhesive or bonding substance which may be activated again at a subsequent stage in carrying out the method according to a process known as heat bonding, sealing or heat sticking. Such gluing marks 12 have lengths corresponding substantially to the width of a second web or sheet 13 continuously travelling in parallel relation to and above said first web which are to be secured thereto during the step B of the process. More specifically portions of said second web are laid down and secured transversely in substantially regularly spaced relationship onto said first web (owing to the gluing marks 12 and once having been affixed between any two successive gluing marks 12, said portions form rectangular elements 14 adapted each one to subsequently form the crown portion of a cap or like headgear.

It should be noted in the specific exemplary embodiment shown in FIG. 1 that each aforesaid portion of the second web 13 is integral therewith and the rectangular elements 14 are defined in this specific case only after adherence to the first web 11 by the fastening step at regular spacings by means of the gluing marks 12 on the web 13 onto the web 11. These rectangular elements will be separated from each other subsequently only but it is obvious that the web or strip 13 could be previously cut into separate elements which are then laid down and secured one by one onto the web 11 by adhesively bonding or sticking each rectangular element thus defined along a first edge 15 thereof at right angles to the running direction of travel of the web 11.

In the exemplary embodiment shown in FIG. 1 each rectangular element 14 is therefore defined between its aforesaid first edge 15 extending at right angles to said running direction of travel and including the corresponding gluing mark 12 and its second edge 16 (shown in chain- dotted lines in FIG. 1) extending in parallel relation to the edge 15 and adjacent to the gluing mark 12 of the foregoing cap. Moreover, it is clearly seen that the second web 13 has a width smaller than that of the first web 11 thereby enabling definition of a longitudinal margin or border 17 on said web 11 when affixing the rectangular elements 14 thereon. As will be shown later that margin 17 provides for an overlapping of the opposite longitudinal edges 18 and 19 of said first web 11 after folding of the latter. The next step consists in depositing or coating gluing marks onto the upper faces of rectangular elements 14. These gluing marks may be of the same character as the marks 12 preferably to enable the use of the adhesive heat bonding or heat sealing process. Thus, in the exemplary embodiment shown in FIG. 1 those gluing marks which are provided on each rectangular element 14 consist of a gluing line, thread or stroke 20 applied adjacent one of the edges 21 of each element 14 and which extend in parallel relation to the running direction of travel of the web or strip 11 and of a gluing line, thread or stroke 22 deposited along one half of the length of said second edge 16 of each element. The following step consists in continuously forming a flat tube 23 from the first web 11 carrying the rectangular elements 14 (step D). The step of forming this flat tube 23 consists in longitudinally folding the web 11 back on itself along a fold line passing substantially through the center of said rectangular elements 14 thus folding said elements substantially in half, and then folding the margin or border 17 of strip 11 over edge 19 of strip 11 so as to cause the opposite longitudinal edge 18 and of the first web 11 to overlap its edge 19. At the same time as the folding process or a short time later the other edges of each one of the folded rectangular elements 14 are assembled with each other as by being connected together. More specifically both free edges of each element 14 extending in parallel relation to the running direction of travel of the web 11 are connected or joined to each other by means of the gluing line 20 whereas said second free edges 16 of each folded element 14 is secured to itself over or throughout the whole length of the folded-back rectangular element by means of the gluing line 22 and such an assembly of the edges of every rectangular element is made with the purpose of forming the crown portion of the cap or headgear. Then the longitudinal edges 18 and 19 are assembled together to complete the formation of said flat tube. As is clearly seen in FIGS. 1 and 2 such an assembly is greatly facilitated by the overlapping relationship of the edges 18 and 19 owing to the margin or border portion 17 being folded over edge 19. This operating step may be carried out in two stages (steps E and F in FIG. 2). The operating step is begun by applying or coating two continuous and parallel gluing marks 24, 25 onto said flat tube on either side of the longitudinal edge 18 left free at the time of forming of the flat tube 23 (step E) and then a continuous stretchable strip 26 is laid down and adhesively bonded over the edge 18 (step F). Finally the last stage of the manufacturing process consists in cutting the flat tube at regular spacings (step G) with a view to severing the finished caps or headdresses. It should be noted in this specific instance that the cutting of the flat tube 23 not only enables the severing of the caps or headgears but also the separation of the rectangular elements 14 which would form the crown portions of these caps since the cutting step is performed along the edges 16. In the step G has been shown a clear or sharp cut-off severing or separation; it is however also possible to contemplate a severance by tearing or ripping off: it would then be only necessary to cut beforehand the set of both webs 11 and 13 before or after their assembly in step B. Moreover, the strip 26 of stretchable material is continuously fed onto the flat tube 23 and divided subsequently into extensible members 27 when performing the cutting operation of step G so as to enable the cap to suitably fit the head of the wearer or user. It is however obvious that for the purpose of effecting savings and facilitating the final severance of the caps said previously cut extensible members or stretchable parts 27 may be fed one by one. At last when it is desired to make caps or headgears of a simpler construction without any extensible elements it would only be necessary to merely and simply fasten the margin 17 to that portion of the web 11 onto which it is folded down. This may be very easily carried out by applying beforehand at any stage of the process depicted in FIG. 1 a gluing mark onto the marginal portion 17 enabling securement together of both longitudinal edges 18 and 19 in mutually overlapping relationship. Such a gluing mark 28 is shown in chain-dotted lines in FIG. 1, but it is plain that such a mark would be provided only in the case where the laying of extensible members 27 is omitted, i.e. in the case where the steps E and F are dispensed with.

FIGS. 3, 4 and 5 show the cap or headgear in such a folded condition as it is obtained at the exit from the production line making use of the method described with reference to FIGS. 1 and 2. In FIG. 3 a first portion *a* of the extensible element 27 has been broken away to enable viewing of the edge 18 which has been covered by the extensible strip 26 whereas another portion *b* broken away enables viewing of an inner border of the crown portion of the headgear as embodied by the gluing line 12. On the other hand another portion *c* broken away on the other side of the folded headgear enables viewing of the central fold 30 of the crown part of the head gear as embodied by the gluing stroke 22. The gluing line 20 is also shown in dash-lines in FIG. 3. From FIG. 6 it clearly appears that when the headgear or cap is unfolded the central fold 30 would extend substantially along a diameter of the crown part of the headgear consisting of the element 14 extended on either side of the gluing mark 22 connecting both halves of the edge 16.

FIGS. 7 and 8 depict another more complete method enabling provision another kind of headgear the crown portion of which exhibits (when said headgear is unfolded as seen in FIG. 13) the shape of a regular polygon. In the exemplary embodiment shown such a crown portion has the shape of an octogon. It should however be pointed out that with the same process crown parts may be made comprising more radial folds and the greater the number of such folds, the more circular the shape of the crown portion will have the tendency to become.

Some operating steps of the process are the same as those which have been described with reference to FIGS. 1 and 2. They are the step H of applying gluing marks **12*a*, the step M of applying gluing marks 24*a* and 25*a*, the steps N of securing the extensible strip 26*a* and the step O of cutting off or severing the headgears which correspond to the steps A, E, F and G, of FIGS. 1 and 2** respectively, and will not be described in greater details for that ground.

The step I of fastening the rectangular elements **14*a* slightly differs from the step B of FIGS. 1 and 2 in that each portion of the second web 13*a* which is affixed at regular spacings onto the first web 11*a* comprises a separate element of said second web cut through at 40 in FIG. 7 by means not shown. Thus, the elements 14*a* are already individualized or separated when they are adhesively bonded onto their respective gluing marks 12*a* along their aforesaid first edges 15*a*. Therefore, the edge 16*a*** is free.

Furthermore, the width of the web **13*a* is less than that of the web 11*a* thereby enabling definition of a longitudinal marginal portion 17*a* as previously and similar to portion 17 of FIGS. 1 and 2. It may however be noted that the positioning of the web 13*a* with respect to the web 11*a* is such that at the time when the elements 14*a* are laid down onto the web 11*a* they are offset or shifted transversely so as to slightly project with respect the edge 19*a* said first web. Such an arrangement subsequently enables securement of said rectangular elements 14*a* to each other independently of the first web 11*a* upon forming the flat tube 23*a*. It is also apparent that separating the rectangular elements 14*a* prior to their fastening onto the web 11*a* enables leaving, if need be, a more or less substantial spacing between each element 14*a* so as to vary the heights of the headgears. Moreover, the previous separation or severing of each element 14a makes it possible thereafter to turn it over by swinging it through 180° (step J) about its line of connection to said first web 11a along said first edge 15a prior to effecting the foldings of web 11a for providing the flat tube 23a**. This step of turning over each rectangular element which will form the crown portion of the headgear would improve the aesthetic appearance of the latter sibe located at the inside of the headgear when the latter is unfolded.

From this stage of the process it is possible to proceed with the applying of gluing marks or lines 20a onto the rectangular elements 14a (step K). The gluing line 20a performs the same function as the gluing line 20 shown in FIG. 1 and enables joining together both opposite edges 43 and 44 of said elements 14a which are parallel to the running direction of travel of the web 11a. On the other hand the gluing line 22 shown in FIG. 1 is replaced by eight gluing dots 42 arranged on the uppermost face of turned over element 14a at regular spacings along said second edge 16a at those locations thereof which are adapted to form the inner folds of the flat tube 23a to be described later. The following step L is the step of forming the flat tube 23a proper which now comprises longitudinal folds. By means of a fold-making or tucking device not shown it is possible to make an even number of alternating folds lengthwise in the web 11a carrying the rectangular elements 14a until drawing near to each other the edges 43 and 44 of the elements 14a. When the folds are fully formed the gluing dots 42 are located substantially in the middle of the flat tube on two parallel rows as shown in FIG. 14. The forming of all those folds may be performed in one single operating step or they may be made by pairs one after the other.

Then at the end of the step L activating again through heating (in the case of adhesive heat bonding) the gluing marks 20a and 42 enables the connection together of the edges 43 and 44 of each element 14a on the one hand and the assembly of the second edge 15a with itself on the other hand, thereby connecting its inner folds to each other. This operating step may be carried out at any time after the foldings for forming the flat tube 23a have been carried out and possibly even after the step O. Moreover, it is also quite possible to dispense with the steps M and N if it is not desired to lay down the extensible elements. In such a case it is for instance possible to apply a gluing mark (not shown) similar to the mark 28 along the marginal portion 17a before the folding step for providing the flat tube 23a.

Figure 12:
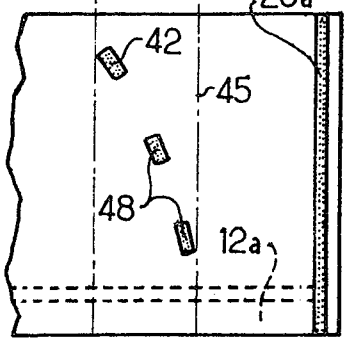
Figure 11:
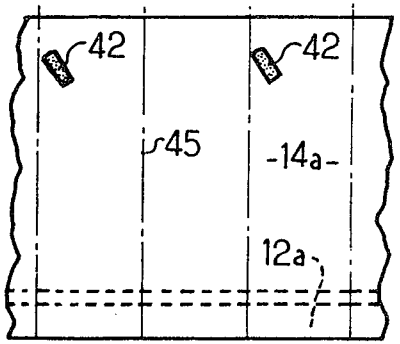
Figure 10:
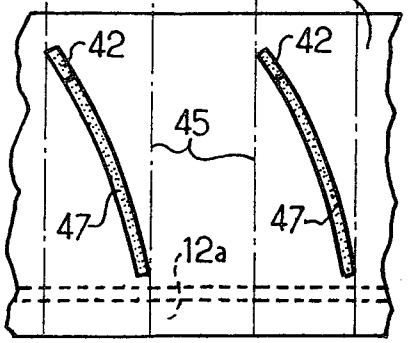
Figure 9:
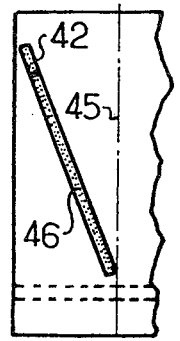

FIGS. 9 to 12 show fragments of a rectangular element 14a on which are drawn different alternative embodiments of gluing marks enabling formation of the crown portion of the headgear as well as their arrangements with respect to the forthcoming fold or crease lines 45 shown in chain-dotted lines. It is thus clearly seen that only the gluing dots 42 are required (FIGS. 7 and 11) but each one of these dots or patches may be extended over the rectangular element 14a by a gluing line applied along a direction which is slightly slanting with respect to the running direction of travel of the web 11a. This gluing line may for instance be either a segment of a continuous straight line 46 (FIG. 9) or a portion of a continuous curve 47 (FIG. 10) or also a portion of a discontinuous curve 48 (FIG. 12). Extending the gluing dots or patches 42 only enables closing of the different folds of the crown portion of the head gear at the time of adhesive heat bonding or sealing so as to impart a greater strength thereto.

FIGS. 13 and 14 show the completed headgear or cap. In FIG. 14 which shows the cap such as it is obtained at the exit from the production line it is clearly seen that all inner folds of the rectangular element 14a are connected along its aforesaid second edge 16a by means of the gluing dots 42 thereby defining a middle point 50 about which is extending in unfolded relationship the crown portion of the cap extends consisting of the rectangular element 14a folded back over itself according to an octogonal configuration during the stage of forming the flat tube 23a. FIG. 13 shows the folded cap of FIG. 14 in its opened condition ready for use.

FIG. 15 shows an alternative embodiment for closing the crown portion of the cap. According to that alternative embodiment it is useless to provide gluing patches 42 during the step K of the process. Merely at the end of the folding step (step L) the inner folds of the flat tube 23a are temporarily left uncovered. This is achieved by delaying the folding-back of the marginal portion 17a and of the edges 43 of the rectangular elements 14a as clearly shown in FIG. 15. It is then only necessary to apply gluing dots 51 at regular spacings onto the inner folds of the second edge 16a of each rectangular element 14a before resuming the normal course of operations, i.e. assembling the edges 43 and 44 of each rectangular element 14a to each other so as to cover said inner folds and complete the closing of the crown portion of the cap. The gluing dot 51 may also be replaced by a stapling of said inner folds.

It is apparent that in the foregoing disclosure some steps may be inverted or reversed in an almost obvious manner without the final result being affected and accordingly without departing from the scope of the invention. Moreover, there has essentially been described assemblies through adhesive bonding and more particularly through heat-bonding, heat-sealing or heat fusing or welding because such processes are more advantageous from an economical standpoint. It is however obvious that other means may be used such as: welding or fusing, sealing or sewing, stapling or clipping and so on.

Furthermore, in accordance with the foregoing disclosure there has been contemplated vairation of the spacings between the rectangular elements 14, 14a when fastening them onto said first web 11, 11a in order to provide caps or headgears of differing heights. In particular it is apparent that by applying this principle it is very easy to convert the caps shown in FIG. 6 and more especially in FIG. 13 into cook's caps. In the same line of thought it is possible to provide a fold in the thus lengthened portion of the cap extending all about the crown part of the skull thereby bringing the cap back to a normal height while changing the appearance thereof since the latter is converted into a particularly aesthetic cap with a double front band. On the other hand by shifting or offsetting some gluing dots (for instance by varying the spacings between the gluing dots or patches 42 shown in FIG. 7) it is possible to produce distortions or asymmetries in the cap in particular at the crown portion of the latter. It is thus easily understandable that by varying the spacings between some gluing dots 42 some triangular sectors of the crown part of the corresponding cap shown in FIG. 13 will be larger than others. Therefore there will be defined in the cap a more bulky back or rear portion converting said cap into a woman's bonnet; said widened rear portion enabling accomodation or housing of the hair.

There will now be described alternative embodiments of the process defined hereinabove, enabling the provision of cowl-like or hood-shaped headgears. Throughout the following the structure elements or the operating steps which have not been modified will be designated by the same reference characters.

Thus, with reference to FIG. 16 there is depicted a method of making headgears with polygonal crown portions derived from the one which is described with reference to FIGS. 7 and 8. In summary the continuous web 11*a* is moving from left to right in FIG. 16 and receives transverse gluing marks 12*a* (step H) which are adapted to secure the previously severed separate rectangular elements 14*a* (step I). Then these elements 14*a* are turned over through 180° (step J) and receive gluing dots or patches 42 (step K) on their uppermost faces before the web 11*a* is being converted into a flat tube with longitudinal folds (step L) and cut to pieces (step O) defining the completed or finished headgears delivered in a folded condition.

However, the method as summarized hereinabove comprises several significant alternative embodiments enabling obtention of cowls or hoods. At first the web 11*a* and the elements 14*a* have of course been widened enough so that the diameter of the headgear corresponds to the width of the head of the wearer or user and no longer only to the crown portion of the skull as previously. Moreover, the gluing marks 12*a* and accordingly the separate elements 14*a* are laid down onto the continuous web 11*a* while leaving some spacings *d* therebetween. This spacing *d* would substantially correspond to the average or mean height between the forehead and the neck of the wearer or user. Furthermore at any stage of the process prior to the step L of forming the flat tube cut-outs or like openings 60 are provided at regular spacings *d* in the continuous web 11*a* (step P). The spacings and positions of the cut-outs or openings 60 are designed so that each cut-out be located in an area of the web 11*a* corresponding to said spacing *d*. The shapes of those substantially triangular or trapezoidal cut-outs will of course enable clearing or uncovering of the face of the wearer. There could also be provided smaller cut-outs only uncovering the eyes and the nose. It should be pointed out that the steps M and N depicted in FIGS. 7 and 8 for fastening an extensible element may advantageously be omitted because such an extensible element is not desirable in this kind of cowl or hood. Therefore in the exemplary embodiment shown in FIG. 16 both of these two operating steps have been replaced by a step M′ of closing the flat tube with longitudinal folds by means for instance of a simple gluing line not shown.

Referring now to FIG. 17 there is depicted a method derived from that which is described with reference to FIGS. 1 and 2. Again there may be found the step A consisting in applying gluing marks like marks 12*a* of FIG. 16 onto the web 11. These gluing marks would embody an assembling line for separate elements 14*b* previously severed from a second web 13*b* travelling this time at right angles to the running direction of travel of the web 11 which is effected from left to right in FIG. 17. After the fastening of the separate elements (step B) gluing threads or lines 22, 20 are applied thereonto (step C), the gluing lines 22 serving as previously to close the crown portions of the head-dresses whereas the gluing lines 20 define together a discontinuous assembling line serving to the forming of the flat tube (step D) without longitudinal folds which is then cut up (step G′ ) to individualize the headgears. The modifications enabling obtention of cowls or hoods of FIG. 19 are the following:

At first as previously the web 11 is wider and the elements 14*b* have corresponding lengths. Moreover, these separate elements are spaced from each other by a distance *d*′ and a side cut-out or notch 65 is provided laterally (to clear the face of the wearer) along one edge of the flat tube, i.e. after the step D. In addition, it should be noted that the line of assembling every element 14*b* with the web 11 as embodied by a gluing mark 12*b* is curved, that it comprises a cusp or like point of reflection or retrogression 66 substantially in the middle of the web 11, that it is symmetrical with respect to this cusp and substantially straight at 67 and 68 on either side of the latter and bent at each one of its ends at 69 and 70 in the same direction as the cusp, i.e. towards the running direction of travel of the web 11. On the other hand at the time of step G′ the step of cutting up the flat tube is substantially modified since it is performed by following the outline of the gluing mark 12*b* superimposed by itself by the folding step for forming the flat tube. More specifically a pair of notches or cuts 72, 73 are provided on either side of the flat tube and arranged in mutually opposing relationship. A first edge 74 of each notch follows a curved portion of the outline of the gluing mark overlying itself whereas the second edge 75 of this notch is straight and transversely aligned in registering relationship with the same corresponding second edge of the other notch. Once these two notches have been provided the cutting of the middle portion of the flat tube is continued as at 76 along a substantially straight path and in extension of both second straight edges 75 while passing along both overlying straight portions 67 and 68 of the gluing mark 12*b*. It results from these additional operating steps that the top of the headgear at the front and at the back portions thereof, respectively, more closely conform to the forehead and the neck of the wearer.

Furthermore the method illustrated in FIG. 17 enables provision of fastening ties or strings arranged at the bottom or base of the headgear. For this purpose each separate previously severed element 13*b* has a width *c* corresponding to the width of the crown portion of the headgear plus the width of a fastening strap or string. Then a cut 80 is effected in the middle of each separate element 14*b* which is directed parallel to the running direction of travel of the continuous web when said separate element is positioned thereon. Moreover this cut extends rearwards of the separate element with respect to the running direction of travel of the web 11 over a distance corresponding at least to the width of a fastening string or strap. As shown in FIG. 17 care is taken to secure each separate element 14*b* onto the web 11 in the front area thereof by means of the glue mark 12*b* and said element 14*b* is affixed at two additional gluing dots 81 on either side of the cut 80 adjacent to each edge of said first web. The gluing dots 81 may be applied at the same time as the gluing mark 12*b*. These additional operating steps are of course carried out before forming the flat tube so that the subsequent cutting of the latter (step G′) will of course be carried out between the curved gluing mark 12*b* and the additional gluing dots 81. Thus, the rear portion of each element 14*b* will be cut into two straps or strings 82 of the next cowl or hood and secured to the latter by means of both gluing dots 81. It should be pointed out that as the gluing marks 20 define a discontinuous assembling line the flat tube thus formed is not closed at 83, i.e. in front of the gluing mark 81 thereby enabling the slipping on of the cowl or hood more easily and in particular to enabling use of both strings or straps 82.

It should be understood that the invention is not at all limited to the embodiments embodiment of the methods which have just been described. In particular there has been stated that the assemblies were obtained by means of gluing marks (or patches or dots). Some of them may be arranged indifferently either on the web 11 or previously on the web **13*b* or also onto the separate elements 14*b***. Preferably this adhesive or glue is of the heat-fusible or sealing type, i.e. it may be activated again by heat when desired at a subsequent stage of the process. The assembling or uniting means may however also be different, i.e. they may in particular involve welding or fusing, stapling or sewing. The invention therefore covers all the technical equivalents of the means disclosed when the latter are used within the scope of the appended claims.

What is claimed is:

1. A method of making on a continuous production line basis caps and like headgears, wherein the improvement comprises the steps of:

causing a first web to continuously move in a running direction of travel;

laying and securing transversely to the width of said first web in substantially regularly spaced relationship onto said first web portions of a second travelling web, each portion constituting a separate element to be ultimately cut off said second web so as to define rectangular elements adapted to form the crown portions of said headgears, the fastening of each rectangular element being carried out along a line extending in at least approximately transverse relation to said running direction of travel, along a first edge of said rectangular element;

forming a flat tube, optionally provided with longitudinal folds, from said first web carrying said rectangular elements, assembling together the other edges of each one of said rectangular elements, both edges of said element parallel to said running direction of travel being connected to each other and the second edge of said element parallel to said first edge of said element along which is effected said fastening being assembled with itself;

securing together both opposite longitudinal edges of said first web in regularly spaced relationship; and finally cutting said flat tube at substantially regular spacings so as to sever completed individual of said headgears therefrom.

2. A method according to claim 1, wherein said step of forming said flat tube consists in folding said web longitudinally back over itself, said second edge of each rectangular element on becoming folded in formation of said tube and being assembled to itself throughout the whole length of said folded rectangular element.

3. A method according to claim 2, consisting in applying preferably continuous gluing marks on each rectangular element at least along one of its edges parallel to said running direction of travel and at least along one half of the length of said second edge of said element.

4. A method according to claim 2 wherein said second web has a width smaller than that of said first web and said rectangular elements formed from said second web are arranged on said first web so as to leave a longitudinal marginal portion near one edge of said first web and wherein the forming of said flat tube is obtained by folding said first web carrying said rectangular elements along a fold line passing substantially through the middle of said rectangular elements and folding back said marginal portion so as to provide an overlapping of the opposite longitudinal edges of said first web prior to their assembly.

5. A method according to claim 1, comprising the steps of making an even number of alternating folds longitudinally in said first web carrying said rectangular elements until the drawing near each other of the edges of said rectangular elements which extend in parallel relation to said running direction of travel to enable their subsequent assembly and assembling said second edge of each one of said rectangular elements with itself while connecting together the inner folds of said last-named second edge; wherein said latter step may be carried out at any stage of said method after folding and even after cutting said flat tube.

6. A method according to claim 5, wherein each aforesaid portion constitutes a separate element cut off said second web, comprising the step of turning each rectangular element through 180° about its fastening line along said first edge of said element prior to carrying out the foldings of said first web for forming said flat tube.

7. A method according to claim 5, wherein gluing marks are applied onto each rectangular element at least one part of which comprise gluing dots arranged in regularly spaced relationship along said second edge of said element at those locations thereof which are adapted to form said inner folds.

8. A method according to claim 7, comprising locating said gluing marks so that each gluing dot is extended over said rectangular element in a direction of travel and being arranged as a continuous or discontinuous line.

9. A method according to claim 5, consisting in temporarily leaving the inner folds of said flat tube uncovered prior to the final formation of said flat tube and applying adhesive in regularly spaced relationship onto said inner folds of said second edge of each rectangular element so as to connect them together, said assembling of the edges of said rectangular elements parallel to said running direction of travel being carried out subsequently so as to cover said inner folds.

10. A method according to claim 5, consisting in temporarily leaving the inner folds of said flat tube uncovered prior to finally forming said flat tube and assembling through said inner folds by stapling of said edge of each rectangular element, said assembling of the edges of said rectangular elements extending parallel with the running direction of travel being carried out subsequently to cover said inner folds.

11. A method according to claim 5, consisting in transversely offsetting said separate elements with respect to said first web when laying said elements down thereon so that they slightly project with respect to said first web.

12. A method according to claim 1, comprising causing said second web to move in parallel relation to said running direction of travel over said first web and cutting said second web into said rectangular elements just before laying and securing said elements in regularly spaced relationship onto said first web.

13. A method according to claim 1, comprising applying preferably continuous transverse gluing marks onto said first web prior to applying thereon said rectangular elements and thereby affixing them onto said first web.

14. A method according to claim 1, wherein said second web has a width smaller than that of the first web and comprising applying said rectangular elements formed from said second web onto said first web so as to leave a longitudinal marginal portion near one edge of said first web to subsequently enable an overlapping of said opposite longitudinal edges of said first web by folding back said marginal portion thereby facilitating their assembly.

15. A method according to claim 4, comprising assembling through adhesive bonding and optionally through heat sealing, said overlapping opposite longitudinal edges of said first web during or before said foldings for forming said flat tube.

16. A method according to claim 15, wherein the assembly of said opposite longitudinal edges is carried out by previously applying at least one preferably continuous gluing mark adjacent to one of said longitudinal edges for instance onto said marginal portion.

17. A method according to claim 1 comprising assembling said opposite longitudinal edges of said first web by securing therebetween a extensible strip.

18. A method according to claim 17, wherein the fastening of said extensible strip is effected by previously applying two continuous gluing marks onto said flat tube on either side of the longitudinal edge of said first web left free upon forming said flat tube.

19. A method according to claim 1 with each aforesaid portion of said second web constitutes an aforesaid severed separate element, wherein said rectangular elements are laid down onto said first web with spacings of a given width therebetween.

20. A method according to claim 1, comprising laying and securing previously severed separate elements onto said first web while leaving determined spacing between the successive separate elements, said spacing subsequently defining in the finished condition of each corresponding headgear a cowl-like lower extension of the latter and providing at least one cut-out in each area of said first web corresponding to said spacing.

21. A method according to claim 20, wherein said fastening of each separate element carried out at right angles to said running direction of travel is effected along one curved assembling line exhibiting a cusp substantially in the middle of said continuous first web, said assembling line being symmetrical with respect to said cusp and substantially straight on either side of the latter and bent at each one of its ends in the same direction as said cusp, said method further comprising the step of subsequently cutting said flat tube along the contour of said assembling line superimposed to itself through the formation of said flat tube to obtain finished headgears, said cut-out being made after the formation of said flat tube along one edge of the latter.

22. A method according to claim 21, wherein said cut-out in said flat tube is obtained:

by providing two notches on either side of said flat tube, positioned in opposing relationship; a first edge of each notch extending along a curved portion of the contour of said assembling line superimposed onto itself and a second straight edge being transversely aligned with the corresponding second edge of the other notch;

and by keeping cutting out in the middle portion of said flat tube along a substantially straight path in the extended alignment of the two aforesaid straight second edges while following both overlying straight portions of said assembling line superimposed over itself.

23. A method according to claim 21, wherein each aforesaid previously severed separate element has a width corresponding to the crown portion of a headgear and to the width of a fastening strap for the next headgear said method further comprising the step of providing a cut in the middle of each separate element directed parallel to the running direction of travel of said continuous strip when said separate element is positioned thereonto, said cut extending rearwards of said separate element with respect to the running direction of travel of said first web over a distance corresponding at least to the width of a fastening strap; securing said separate element onto said first web in the front area thereof and affixing said element at two additional points on either side of said cut adjacent to each edge of said first web prior to proceeding with the forming of said flat tube and with the cutting of said flat tube between said curved assembling line and both of said additional fastening points of each separate element.

24. A method according to claim 21, comprising forming said assembling line by applying gluing lines or dots, respectively, onto said first web and optionally onto said separate elements preferably from heat sealable adhesive material which may be activated through heat when desired at any subsequent stage of said method.

25. A method according to claim 21, wherein said assembling lines are embodied by welding, fusing or sealing of some portions of said first web and optionally of said separate elements.

26. A method according to claim 21, wherein said assembling line and optionally said fastening points are effected as by stapling and or sewing of some portions of said first web and said separate elements.

27. A headgear obtained by carrying out the method according to claim 1.

* * * * *